United States Patent [19]

Hsing

[11] Patent Number: 4,854,254

[45] Date of Patent: Aug. 8, 1989

[54] PULL ROLLER MOUNT FOR SEWING MACHINES

[76] Inventor: Hsiau C. Hsing, No. 9, Alley 41, Lane 11, Hua Cheng, Taipei R.O.C., Taiwan

[21] Appl. No.: 32,269

[22] Filed: Mar. 31, 1987

[51] Int. Cl.[4] ..... D05B 27/10

[52] U.S. Cl. ..... 112/305; 112/322

[58] Field of Search ..... 112/305, 318, 322, 113

[56] References Cited

U.S. PATENT DOCUMENTS

| | | | |
|---|---|---|---|
| 2,535,234 | 12/1950 | Schwartz | 112/322 |
| 3,726,240 | 4/1973 | Emich | 112/322 X |
| 3,886,878 | 6/1975 | Block | 112/322 |
| 4,187,795 | 2/1980 | Norton | 112/305 X |
| 4,441,438 | 4/1984 | Takahashi | 112/113 X |

*Primary Examiner*—H. Hampton Hunter

*Attorney, Agent, or Firm*—Cushman, Darby & Cushman

[57] ABSTRACT

A device for tensioning material to be sewn includes a driven pull roller, a connecting plate for shifting the pull roller upwardly when the presser foot of a sewing machine is raised, and a cammed guide track and follower support for the pull roller that causes the pull roller to retract outwardly with respect to the presser foot when the pull roller is shifted upwardly. Also provided is a handle for retracting the pull roller assembly independent of the motion of the presser foot.

4 Claims, 5 Drawing Sheets

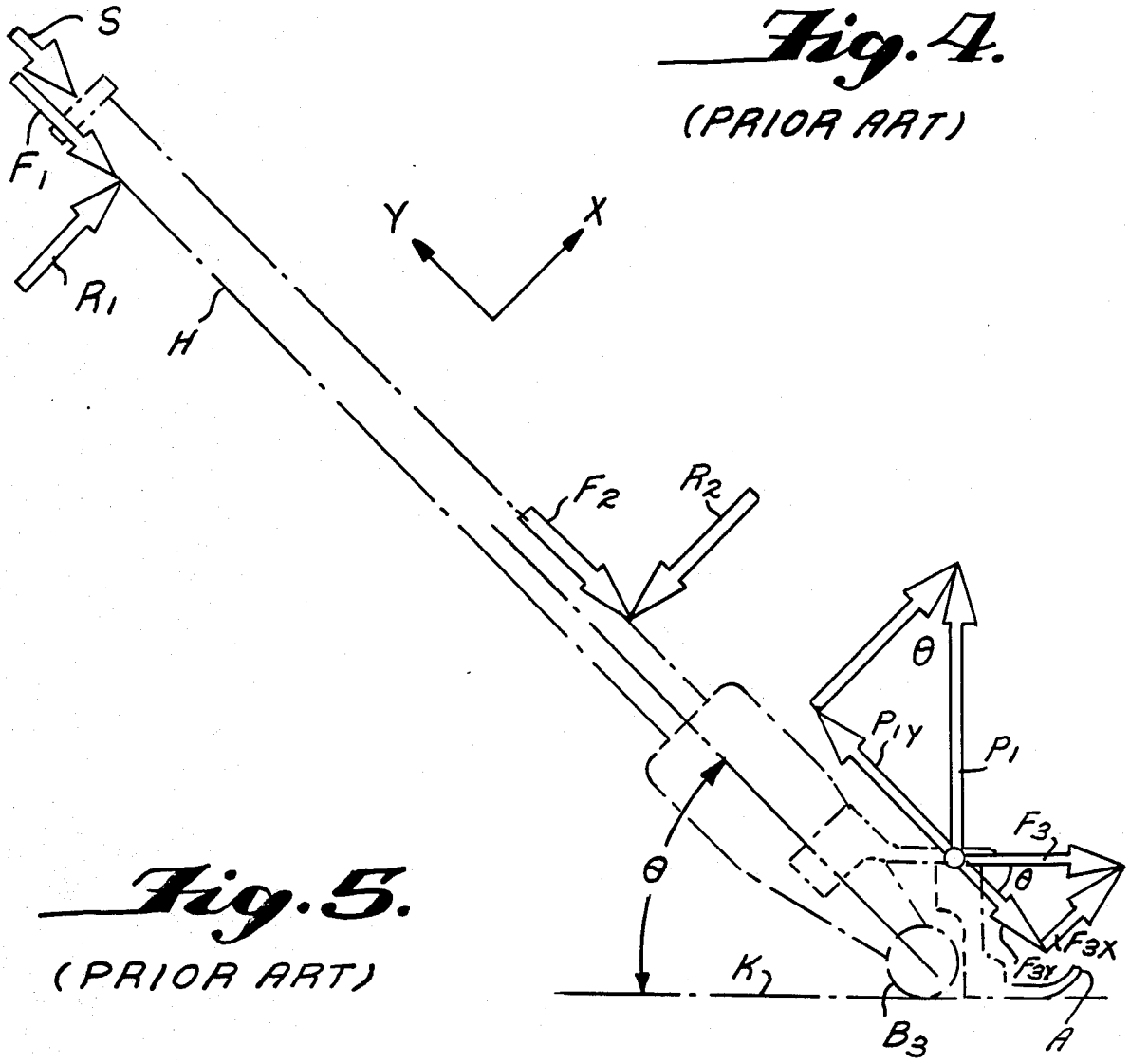
Fig. 4.
(PRIOR ART)
Fig. 5.
(PRIOR ART)
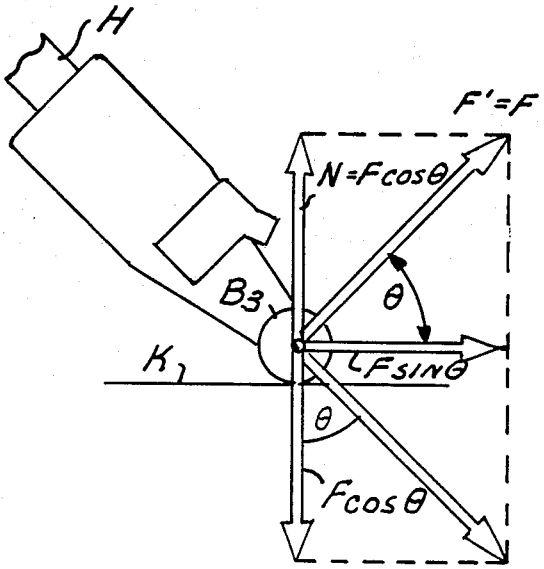

PULL ROLLER MOUNT FOR SEWING MACHINES

BACKGROUND OF THE INVENTION

1. Field of the Invention

The present invention relates to sewing machines, and more particularly, to pull rollers which are used for pulling fabric past a sewing needle.

2. Description of the Prior Art

When sewing some types of soft and elastic fabric materials with traditional sewing machines, a common problem which develops is the forming of wrinkles on the fabric. This problem long impeded progress in the garment industry in upgrading the quality of sewing, since bunching or wrinkling can occur while using even high quality fabric materials. In the past, domestic sewers in the home have solved the wrinkling problem by tensioning the fabric material to be sewed by pulling it with their hands. Until recently, this solution was not practical on a mass production basis. A few years ago, a puller device was developed for a sewing machine wherein a pull roller was used to maintain tension on the fabric while it was being sewn.

FIG. 1 illustrates one type of pull roller arrangement that is known in the art. A sewing machine having a needle F and a presser foot A is provided with a support mechanism for a pull roller $B_1$. A power rotary shaft C is provided for turning the pull roller $B_1$. In operation, a piece of material to be sewn is pinched between pull roller $B_1$ and a driven roller D so that tension is maintained in the material along a distance G between the rollers and the needle F.

Although the apparatus shown in FIG. 1 was effective to some degree in eliminating the wrinkling problem, there were also disadvantages in the design, examples of which are:

1. The relatively long distance G between the point of application E of the pull roller $B_1$ to the material to be sewn and the sewing needle F allows the tensioned portion of the material to expand relative to surrounding portions thereof during sewing, resulting in an inferior quality of garment.

2. The relatively long distance G between the point of application E of the pull roller $B_1$ to the material to be sewn and the sewing needle A also makes it difficult to turn the fabric while sewing.

3. Also owing to the relatively long distance G between the point of application E and the sewing needle F, small pieces of material such as labels cannot be tensioned while they are being sewn to an underlying material.

FIG. 2 illustrates another type of pull roller assembly that is known in the prior art. As in the apparatus of FIG. 1, a sewing needle F is provided on a sewing machine along with a presser foot A. A relatively small pull roller $B_2$ is provided to tension the material to be sewn. As in the apparatus of FIG. 1, the pull roller $B_2$ in FIG. 2 is mounted for linear movement, although pull roller $B_2$ can be mounted much closer to the sewing needle F because of it size and because of a recess $A_1$ that is provided in the heel of the presser foot A. Although the prior art apparatus illustrated in FIG. 2 solved many of the problems that were present in the apparatus of FIG. 1, its design created additional problems, most of which are:

1. The positioning of the pull roller $B_2$ in the recess $A_1$ in the heel of the pressure foot limited the distance the pull roller could be lifted above the material to be sewn. Thus, it was impossible to completely disengage the pull roller $B_2$ from the material to be sewn when sewing an especially thick material.

2. Since the pull roller $B_2$ was disposed within the recess $A_1$ in the presser foot, it was difficult to completely disengage the pull roller $B_2$ from material that did not need to be tensioned while it is being sewn. For that reason, the apparatus illustrated in FIG. 2 had utility only for sewing certain types of soft or elastic materials.

FIG. 3 illustrates another type of prior art material tensioning apparatus. A sewing machine having a sewing needle F and a presser foot A is provided with a recess in the heel $A_1$ of the presser foot and an inclined linear mounting assembly for a pull roller $B_3$. The pull roller $B_3$ is driven downwardly by means of a spring biased gliding rod H toward a worktable K. A plate I is provided on the mounting assembly so that the pull roller $B_3$ is automatically lifted from the worktable K when the presser foot A is moved upwardly. In addition, the angle of inclination of the mounting means H for the pull roller $B_3$ prevents the pull roller from abutting the heel $A_1$ of the presser foot while it is being withdrawn from the material. Although the apparatus illustrated in FIG. 3 solved many of the problems that were presented in the devices in FIGS. 1 and 2, its design created new problems, examples of which are:

1. During sewing, it will sometimes be desirable to adjust the angle of inclination $\theta$ between the axis of the driving rod H and the plane of the worktable K. However, when this is done, the force necessary to raise the presser foot A also changes. When $\theta$ is small, it takes relatively little force to lift the presser foot. However, when $\theta$ is large, it takes a great deal more force to lift the presser foot A. This increases the difficulty of operation of the apparatus, as well as decreasing the quality of the garment being sewn. A vector analysis of this problem is illustrated in FIGS. 4 and 5. In those Figures, $P_1$ is the force of application; $R_1$ and $R_2$ are the reaction forces exerted by the mounting assembly on the driving rod H; $F_1$ and $F_2$ represent the frictional forces generated by the reaction force; $F_3$ represents the frictional force generated between the presser foot A and the plate I, and S represents the spring biasing force that is exerted on the driving rod H. From FIGS. 4 and 5, it is evident that in order to raise the presser foot, $P_1\theta$ must be greater than $S+F_1+F_2+F_3 \cos \theta$. Thus, the larger $\theta$ becomes, the greater the lifting force $P_1$ is needed to lift the presser foot A.

2. The frictional forces $F_1$ and $F_2$ which are generated between the driving rod H and the mounting assembly themselves generate a moment of force which tends to rock the pressure foot in its bearings and increases the difficulty in raising the pressure foot.

3. The rightward component of force that is exerted by the puller roller $P_3$ on the material, as illustrated in FIG. 4, can cause the material to bunch up in front of the roller, which defeats the purpose of the apparatus.

Clearly, there exists a long and unfilled need in the prior art for a puller roller assembly for a sewing machine without the above discussed disadvantages.

SUMMARY OF THE INVENTION

An object of the present invention is to provide a tensioning device for a sewing machine which has a pull roller with a small diameter that can be retracted from the material by applying a constant upward force to the presser foot of the sewing machine.

A further object of the present invention is to provide a pressure roller assembly for a sewing machine wherein the pull roller can approach the presser foot as closely as possible.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 4 is a force diagram exemplary of the forces between the various elements in FIG. 3;

FIG. 5 is another force diagram illustrative of other forces which are present in prior art FIG. 3.

DETAILED DESCRIPTION OF THE PREFERRED EMBODIMENT

Figure 6:
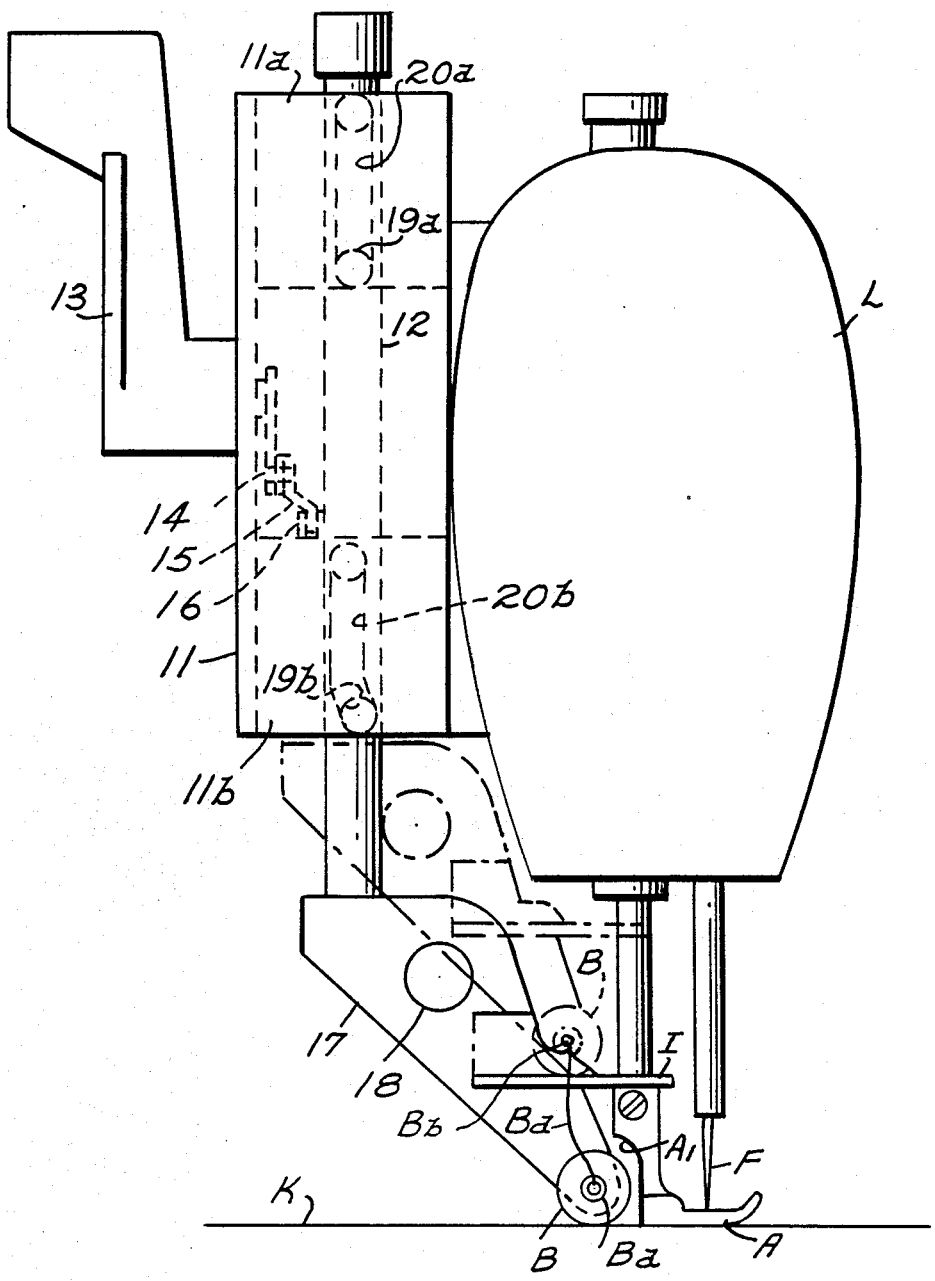
FIG. 6 is a side plan view of the improved pull device of the present invention.

As illustrated in FIG. 6, the puller device of the present invention includes a support 11 which is fixed on the side of the sewing machine L, and a driving rod 12 which can move upwardly and downwardly relative to upper and lower parts 11*a*, 11*b* of the support 11. A pivotally mounted handle member 13 is provided to shift the driving rod 12 upwardly and downwardly by means of an eccentric pin 14 that is connected to the handle 13 and drives a connecting rod 15 that is pivotally attached to the driving rod 12 by means of a pin 16.

A small pressure roller B is fixed to the lower end of the driving rod 12 by means of an extension member 17. Pressure roller B is rotated by means of a gear or belt (not shown) attached to rotating shaft 18. In this way, rotation of the pull roller B is synchronized with the sewing action of the machine in order that the material being sewn may be properly tensioned.

A connecting plate I is attached to the extension member 17 so that the extension member 17 and the pull roller B are retrated when the pressure foot A of the sewing machine is lifted.

On the upper and lower ends of the driving rod 12 are positioned sliding members 19*a* and 19*b*. Sliding members 19*a* and 19*b* are positioned for sliding engagement with a pair of guide tracks 20*a*, 20*b*, respectively, which are positioned in the support member 11. The first guide track 20*a* is formed to be linear. The second guide track 20*b* is linear along its top and bottom sections, but has a curve therein which corresponds to the curve in the heel $A_1$ in the presser foot A.

Figure 1:
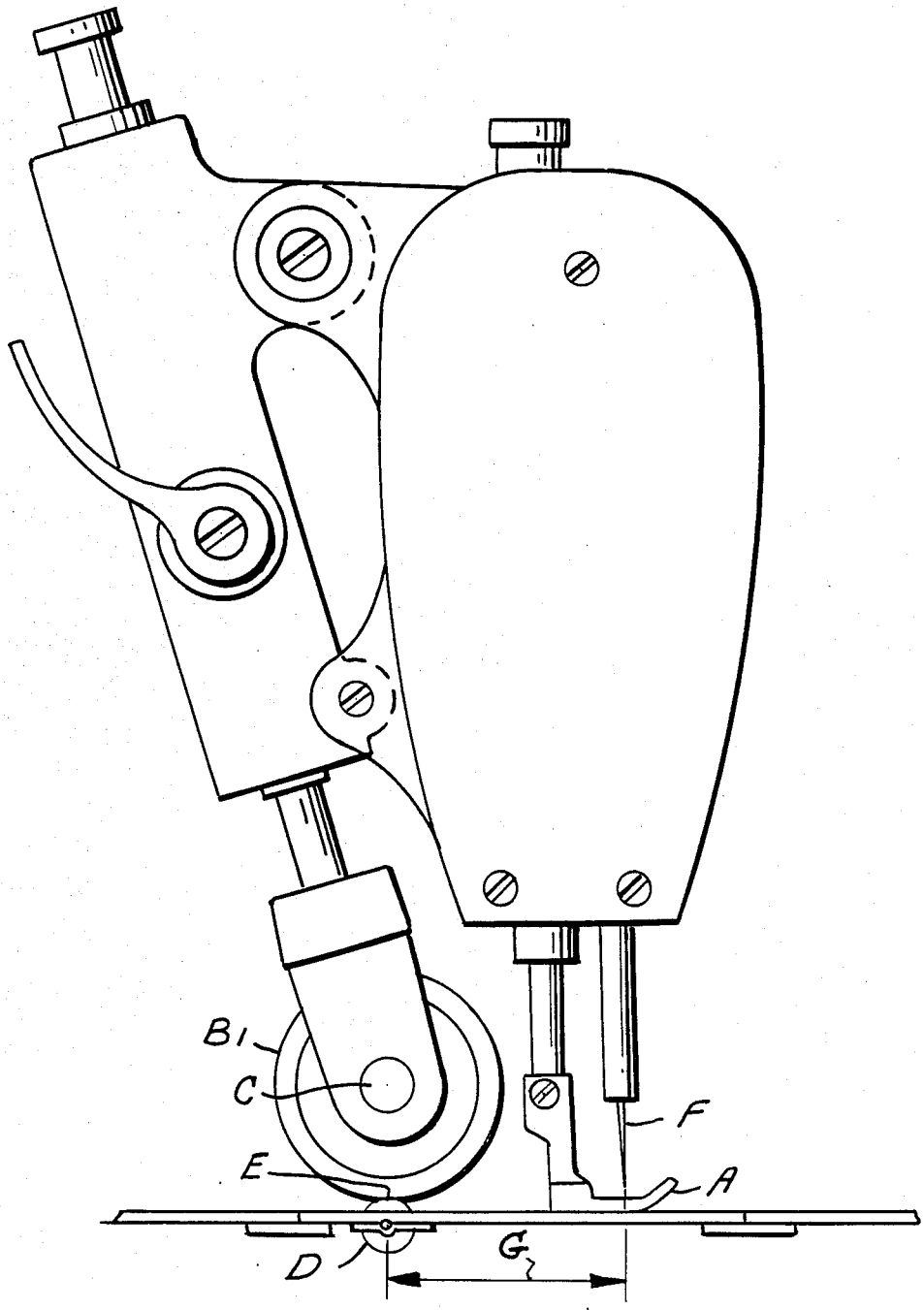
Fig. 1. (PRIOR ART)
FIG. 1 is a plan view of a first prior art puller device.
Figure 2:
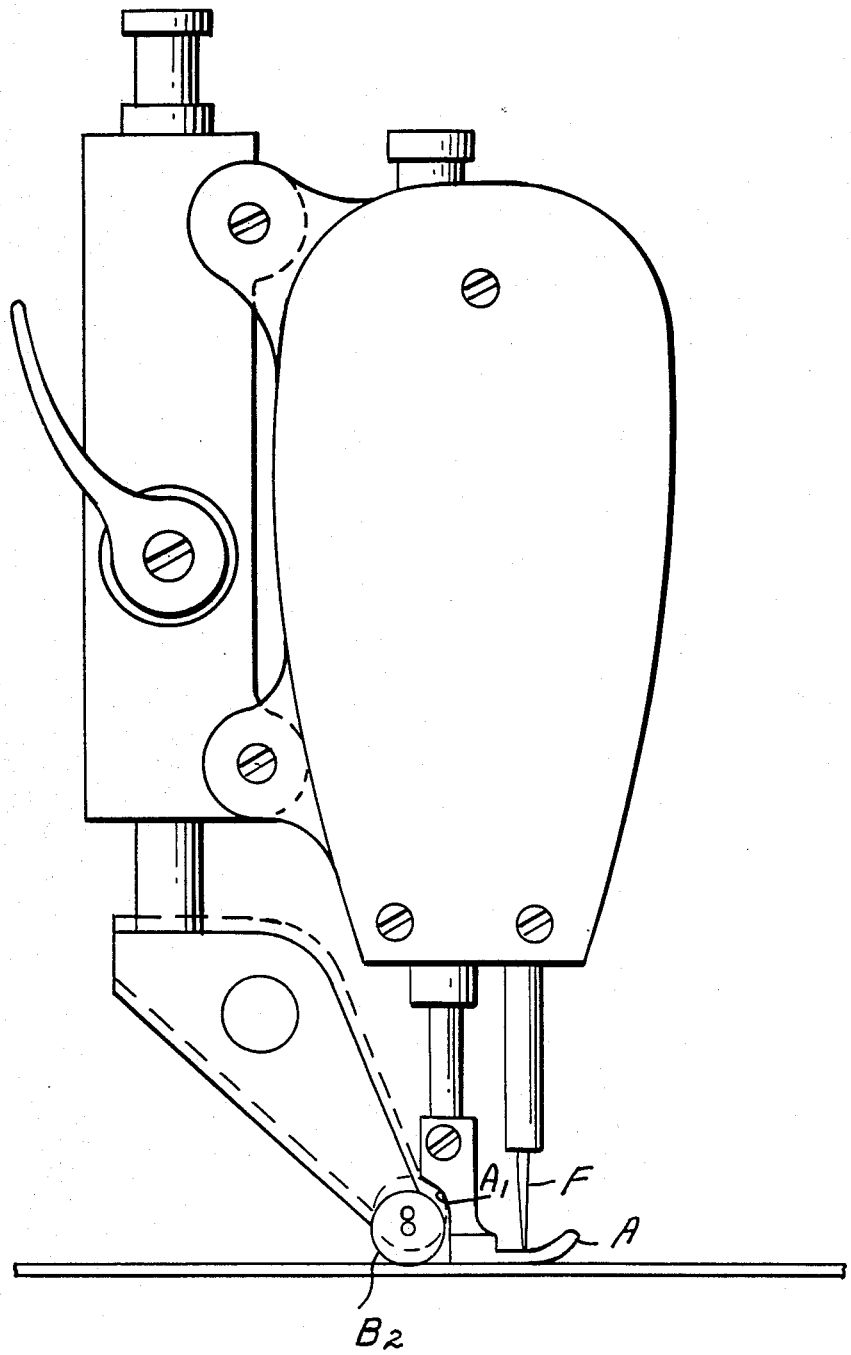
FIG. 2, is a plan view of a second prior art puller device.
Figure 3:
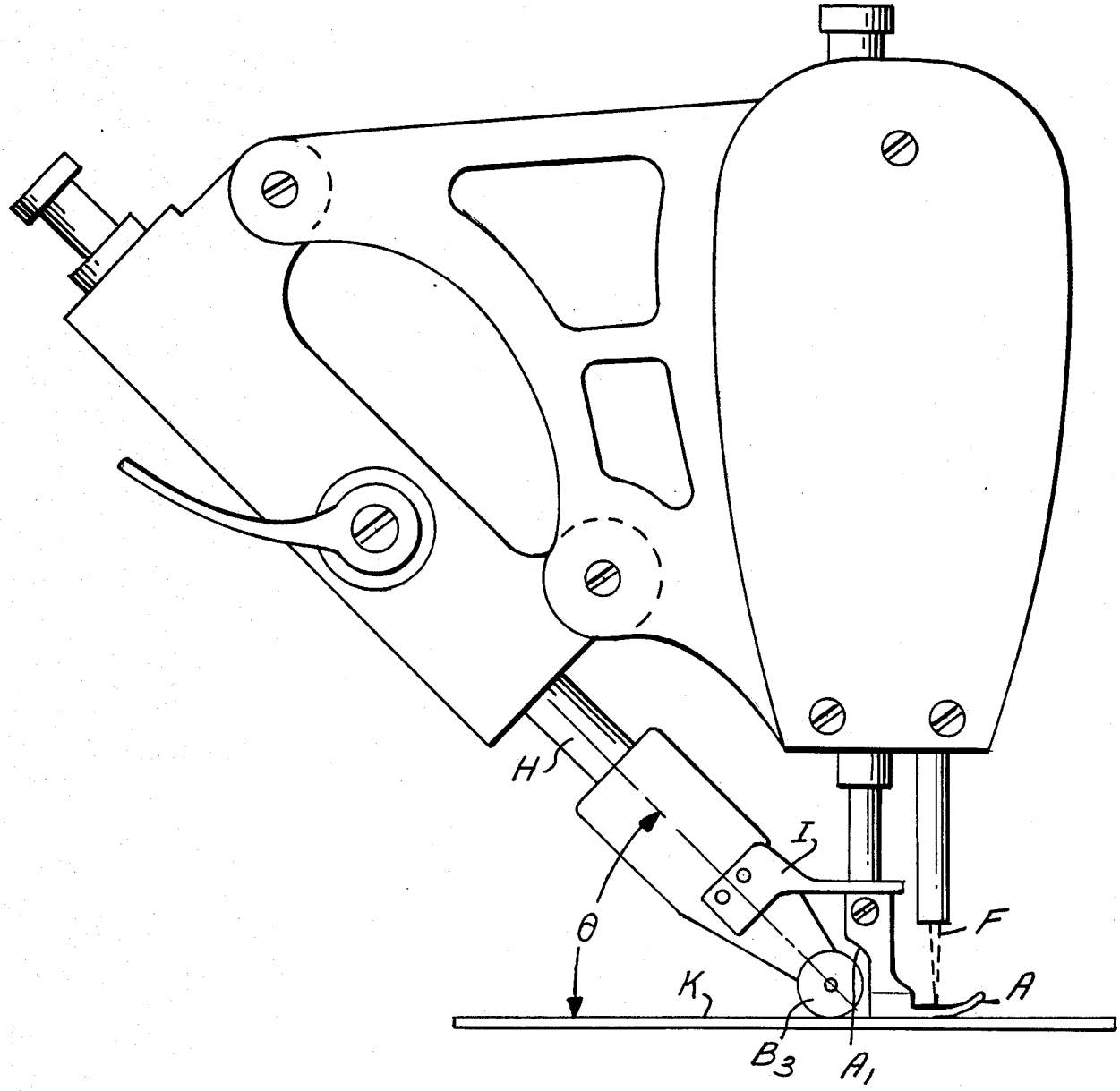
Fig. 3. (PRIOR ART)
FIG. 3 is a plan view of a third prior art puller device.

In operation, when the pressure foot A of the sewing machine is lifted by an operator, the pull roller B will not be stopped by the heel $A_1$ of the presser foot A, as was the case in the prior art design of FIG. 2. Rather, the curve in guide track 20*b* allows the extension member 17 with the pull roller B thereon to retract upwardly and outwardly so that the pull roller B may come to a resting position $B_b$, as is shown in phantom in FIG. 4. In addition, it is possible to retract the extension member 17 with the pull roller B thereon from the worktable K by turning the handle 13 when it is not necessary to tension the material to be sewn.

Although the sliding members 19*a* and 19*b* are illustrated as pins in the preferred embodiment, it is to be understood that various types of cam followers could be employed with similar effect. In addition, although the upper guide member 20*a* is illustrated as linear, it could also be curved like the guide member 20*b* with now material effect on the operation of the invention.

In summary, it is clear that the present invention provides an improved apparatus for tensioning material to be sewn wherein constant tension may be applied to a material without wrinkling the material, is convenient to operate and can conveniently be retracted when not in use.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

I claim:

1. A material tensioning device for a sewing machine having a pressure foot comprising:

a pull roller for tensioning material being sewn;

means for rotating said pull roller;

connecting plate means for shifting said roller upwardly when the presser foot is lifted; and means for guiding said roller during upward and downward movement, said guide means including first and second guide tracks supported by the sewing machine, said second guide track having a curved portion thereon, and first and second sliding members attached to said roller and mounted for sliding engagement with said first and second guide tracks, respectively, whereby said roller is shifted outwardly away from said presser foot during upward movement.

2. Material tensioning device for a sewing machine according to claim 1, wherein said first guide track is linear.

3. A material tensioning device for a sewing machine according to claim 1, further comprising:

additional means for shifting said pull roller upwardly, said additional means including a handle, and means for moving said first and second sliding members upwardly and downwardly relative to said first and second guide tracks, respectively, responsive to rotation of said handle.

4. A material tensioning device for a sewing machine according to claim 1, wherein said guide tracks are formed as slots in a support member that is attached to the sewing machine, and said sliding members are formed as pins which fit in said guide slots.

* * * * *